US006125567A

United States Patent [19]

Roy

[11] Patent Number: 6,125,567

[45] Date of Patent: Oct. 3, 2000

[54] SELF-FASTENING TURN BUTTON FOR PICTURE FRAMES AND METHOD OF INSTALLING SAME

[75] Inventor: Armand E. Roy, Attleboro, Mass.

[73] Assignee: Craft, Inc., South Attleboro, Mass.

[21] Appl. No.: 09/354,496

[22] Filed: Jul. 16, 1999

[51] Int. Cl.[7] ..... G09F 1/12

[52] U.S. Cl. ..... 40/790; 411/501

[58] Field of Search ..... 40/790; 411/179, 411/501, 502, 504

[56] References Cited

U.S. PATENT DOCUMENTS

| | | | |
|---|---|---|---|
| 157,116 | 11/1874 | Bray | 411/501 |
| 216,719 | 6/1879 | Bray | 411/501 |
| 908,608 | 1/1909 | Pullen | 40/790 |
| 4,996,784 | 3/1991 | Hsu | 40/790 |
| 5,379,537 | 1/1995 | Roy . | |

FOREIGN PATENT DOCUMENTS

| | | | |
|---|---|---|---|
| 147941 | 11/1902 | Germany | 40/156 |

*Primary Examiner*—Cassandra H. Davis
*Attorney, Agent, or Firm*—Barlow, Josephs & Holmes, Ltd.

[57] ABSTRACT

A turn button for a picture frame back includes an elongated metal body portion. A pivot boss is provided on the bottom side surface adjacent to a first end. The pivot boss includes an upstanding cylindrical wall with a free upper edge and an aperture therethrough for rotatably securing the turn button to a first portion of a picture frame. The free upper edge of the cylindrical wall serves as a cutting edge and is capable of piercing through a picture frame back. A smooth glide pad is also provided and has a substantially smooth outwardly facing surface for engaging a second portion of the picture frame in order to retain a second portion in a predetermined position relative to the first portion and to avoid excess damage to the picture frame back. A turning knob is also provided to facilitate hand manipulation of the turn button by the user. The use of the cylindrical wall as a cutting edge avoids the use rivets for attachment and the pre-punching of holes into the picture frame back prior to installation of the turn button.

6 Claims, 8 Drawing Sheets

SELF-FASTENING TURN BUTTON FOR PICTURE FRAMES AND METHOD OF INSTALLING SAME

BACKGROUND OF THE INVENTION

The present invention relates to hardware for picture frames and more particularly to a turn button for releasably retaining the back of a picture frame, or a portion of the back thereof with respect to the remainder of the picture frame.

Turn buttons, comprising pivotally mounted sheet metal retaining arms, are widely used for releasably retaining various components of picture frames in position during use. However, the main applications for turn buttons are generally for either retaining the backs of picture frames in position relative to the respective frame portions thereof or for retaining the door back portions of picture frame backs in position relative to the remaining portions of the respective backs thereof. In this regard, when a turn button is utilized in connection with a picture frame which includes a back comprising a single, continuous, uninterrupted panel made from a sheet material, such as cardboard, it is normally secured to the rear side of the peripheral frame portion of the picture frame so that the turn button is pivotable inwardly for retaining the picture frame back in position during use.

On the other hand, when a turn button is utilized in connection with a picture frame, which includes a back comprising a peripheral portion and an integrally formed rearwardly hinged door back portion which is adapted to provide access to the interior of the picture frame. The hinge of such a door back portion is commonly formed by scoring the picture frame back along one side while fully cutting the remaining three sides of the door back portion. The turn button is normally pivotally secured to the peripheral portion of the back so that it can be utilized for retaining the door back portion in position during use. Also, the door back itself may be completely separable from the peripheral portion.

The most common type of heretofore available turn button comprises an elongated generally oval-shaped planar member which is blanked from a sheet metal and which has an aperture formed adjacent one end thereof. A fastener, such as a rivet, screw or nail, secures the turn button to the picture frame back while allowing for the necessary pivoting between open and closed position. However, it has been found that turn buttons of this general type have several disadvantages. It has been found that because turn buttons of this type are generally blanked from sheet metals they often have relatively sharp edges which can scratch or mar the backs of picture frames as the turn buttons are pivoted. This is particularly true when turn buttons of this type are used on picture frame backs which include rearwardly facing felt laminates or the like. Also, because turn buttons of this type are generally substantially planar in configuration, they can be difficult for users to manipulate for pivoting them between operative and inoperative positions thereof. Also, if the fastener is not secured properly or becomes loose, the turn button can freely rotate causing an undesirable "helicoptering" effect thus being incapable of adequately serving as a closure.

A primary disadvantage of this prior art turn button is the aforesaid requirement of a separate fastener. The employment of a fastener, such as a rivet, requires precise alignment of the turn button and a second step of attaching the fastener. The configuration of this type of prior art turn button, being flat, makes it completely unsuitable for automatic assembly such as with vibratory feeder assemblies or formation into wound continuous strips for coil-fed automated feeder assemblies. As a result, flat turn buttons with separate fastening elements are difficult and labor intensive to install and cumbersome to operate.

Attempts have been made in the prior art to facilitate the installation of turn button by automating the process and obviating the need for a separate fastener element. These prior art turn buttons provide a flat body with an integrated fastener element which is received by a pre-punched hole in the picture frame back. However, this prior art turn button suffers from the disadvantages of requiring the pre-punching of holes to receive the turn button to ensure proper attachment to the picture frame back. In addition, the step of installing the turn buttons must be carried out separately from other hardware installation steps and cannot be carried out inline with such other hardware installation steps.

Also, prior attempts to automate the turn button manufacture and installation process have also proved to be inadequate. Known automated methods employ a vibratory feeder to align and prepare the turn buttons for installation. However, use of a vibratory feeder arrangement suffers from jamming and snagging of the small turn button parts therein and debris in the feed bowl resulting in extended periods of unwanted down time.

In view of the foregoing, there is a demand for an improved turn button that can be automatically installed on a picture frame back without the need for separate fasteners. There is also a demand for a turn button to be installable without the need for pre-punching holes. There is a further demand for a turn button that does not mar the surface of the picture frame back. There is a particular demand for a fully automated method of manufacturing and installing turn buttons in a single inline process.

SUMMARY OF THE INVENTION

The present invention preserves the advantages of prior art turn buttons for picture frames and methods of manufacturing and the installing the same. In addition, the improved turn button and manufacturing and installation methods of the present invention provides new advantages not found in currently known devices and methods and overcomes many disadvantages of such currently available devices and methods.

The invention is generally directed to the novel and unique turn button for picture frames as well as the novel and unique method of manufacturing the turn button, the method of installation the turn button on a picture frame back. The turn button of the present invention includes an elongated metal body portion. A pivot boss is provided on the bottom side surface adjacent to a first end. The pivot boss includes an upstanding cylindrical wall with a free upper edge and an aperture therethrough for rotatably securing the turn button to a first portion of a picture frame. The free upper edge of the cylindrical wall serves as a cutting edge and is capable of piercing through a picture frame back. A smooth glide pad is also provided and has a substantially smooth outwardly facing surface for engaging a second portion of the picture frame in order to retain a second portion in a predetermined position relative to the first portion and to avoid excess damage to the picture frame back. A turning knob is also provided to facilitate hand manipulation of the turn button by the user. The use of the cylindrical wall as a cutting edge avoids the use of rivets for attachment and the pre-punching of holes into the picture frame back prior to installation of the turn button.

The turn button of the present invention is, preferably, formed into a coil by progressive tooling. Each turn button included a body portion and a pivot boss having a cutting free edge. A substantially flat sheet of substantially rigid, formable material is provided and a series of domes at spaced points along the sheet are formed by drawing the formable material a predetermined amount. The domes are formed to a desired circumference and a series of through-holes are formed in each of the domes, respectively. The domes are extruded into a cylindrical wall having a height and defining a pivot boss. Portions of the sheet are sheared to define a substantial part of the periphery of the turn buttons leaving portions of the formable material between each of the turn buttons to form a coil of connected turn buttons. The coil of connected turn buttons can be easily pre-plated or process to suit the application at hand.

A method of installing a turn button on a picture frame back is also provided by the present invention. A turn button is provided with a main body and a pivot boss thereon. The pivot boss includes an upstanding cylindrical wall, from the main body and defining an aperture therethrough, with a free cutting edge capable of piercing through the picture frame back. A ball nose punch is provided below and proximal to a lower surface of the picture frame. The turn button is positioned over the picture frame back with the cutting edge of the cylindrical wall proximal to the picture frame. The pivot boss is driven through the picture frame back with the cutting edge of the cylindrical wall piercing through the picture frame back into communication with the ball nose punch so that the free cutting edge is flared out to prevent removal of the pivot boss from the picture frame back while pivotally securing the turn button to the picture frame back. As a result, the employment of a coil-fed system for installing turn buttons ensures excellent delivery of the product at high speed without the aforementioned drawbacks of vibratory feeding systems. The speed and reliability of such coil-fed automated machinery makes it well-suited for positioning inline with other picture frame hardware assembly procedures, such as the attachment of easel hinges. As a result, the likelihood of a turn button assembly stoppage or failure is much less than prior art methods which would cause an entire assembly line to cease production.

For use and operation of the turn button of the present invention, the turn button is pivotally secured to the rear side of the frame portion of a picture frame or to the peripheral portion of a picture frame back without the need for a separate fasting element, such as a screw or a rivet, or the need for pre-punching of holes is through the picture frame back. The turn button is assembled so that the pivot boss and the glide pad the adjacent rearwardly facing portions of the picture frame, and accordingly as the turn button is pivoted, the face portion of the pivot boss is rotated on the adjacent rearwardly facing surface of the picture frame. Further, the only other portion of the turn button which actually contacts the picture frame back is the glide pad which, because of its smooth configuration, is not likely to scratch or cause damage to the back of the picture frame as the turn button is pivoted. The turn button includes a turning button on a second side thereof to facilitate rotation of the turn button by a user. The turning button is grasped or pushed to, in turn, pivot the turn button between operative and inoperative positions thereof.

The turn button uses elevated components from the body portion, the turn button construction is well suited to formation into a long coils of connected turn buttons and winding onto large spools for coil-fed automated equipment. In particular, the elevated components provide integral spacers to ensure neat stacking of the coil about a spool to prevent unwanted locking or jamming of the coil. Therefore, the turn button of the present invention can be effectively assembled on a picture frame utilizing a high speed automated assembly machine.

Accordingly, it is a primary object of the instant invention to provide an improved turn button for a picture frame.

Another object of the instant invention is to provide a turn button which is adapted to be secured to a picture frame and which is pivotable relative to the picture frame without causing damage to the back thereof.

Still further, an object of the instant invention is to provide an effective turn button that can be coil fed at high speed utilizing an automated assembly apparatus.

It is yet another object of the present invention to provide a turn button that obviates the need for a separate fastener, such as a rivet or screw.

A further object of the present invention is to provide a turn button that obviates the need for pre-punching fastener holes in the picture frame.

Another object of the present invention is to provide method of manufacture for forming a coil of turn buttons for automated assembly.

Yet a further object of the present invention is to provide a method of installing a turn button without a separate fastener or pre-punching a hole prior to installation of the turn button.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
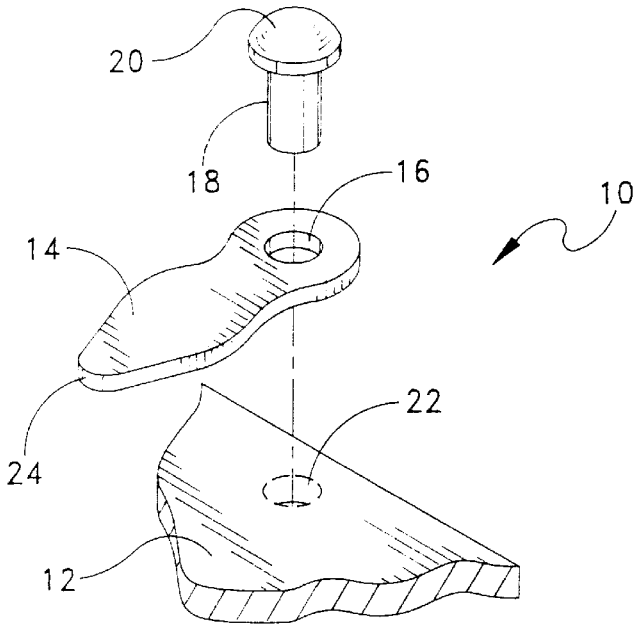
FIG. 1 (PRIOR ART)
FIG. 1 is perspective view of a prior art turn button employing a separate fastener.

Referring first to FIG. 1, a perspective view of a first prior art turn button arrangement 10, for attachment to a picture frame back 12, is shown. This particular prior art turn button 10 includes a flat body portion 14 with a fastener aperture 16 therethrough. A fastener 18, such as a rivet, which includes a head 20, secures the flat body portion 14 to the picture frame back 12. The installation of the fastener 18 creates a hole 22 in the picture frame back when installed. However, the body portion 14 and fastener 18 are typically aligned over the desired portion of the picture frame back 12 and a press (not shown), or other machine, drives the fastener 18 through the body portion 14, through the picture frame back 12 and into an anvil or punch (not shown) to secure the fastener 18 in place.

The installation of the prior art turn button 10 of FIG. 1 is labor intensive in that it requires a separate fastener 18 and precise attachment. In addition, the flat configuration of this turn button 10 will cause scratching and other marring of the surface of the picture frame back 12 due to the sharpness of edges 24, which are typically stamped from a sheet, of the body portion 14.

Figure 2A:
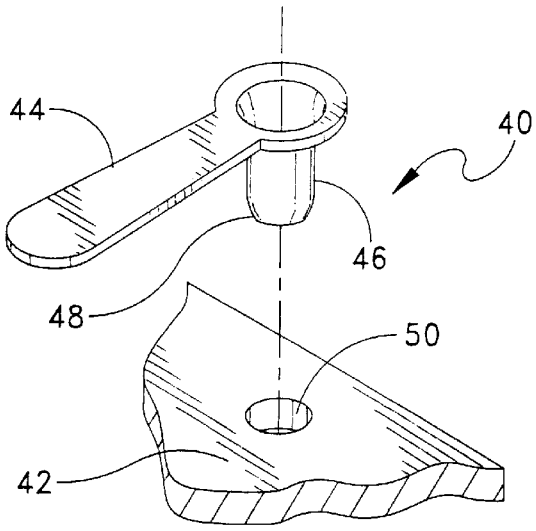
FIG. 2A (PRIOR ART)
FIG. 2A is a perspective view of a prior art turn button employing with an integrated pivot post and requiring a pre-punched hole.
Figure 2B:
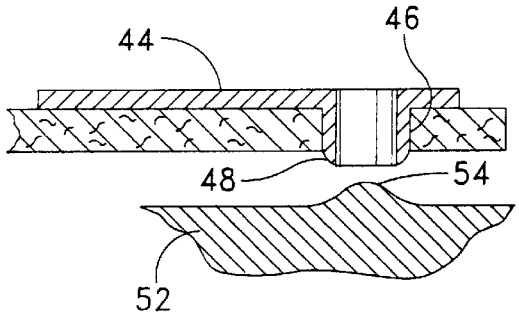
FIG. 2B (PRIOR ART)
FIG. 2B is a cross-sectional view through the line 2B—2B of FIG. 2A.
Figure 3:
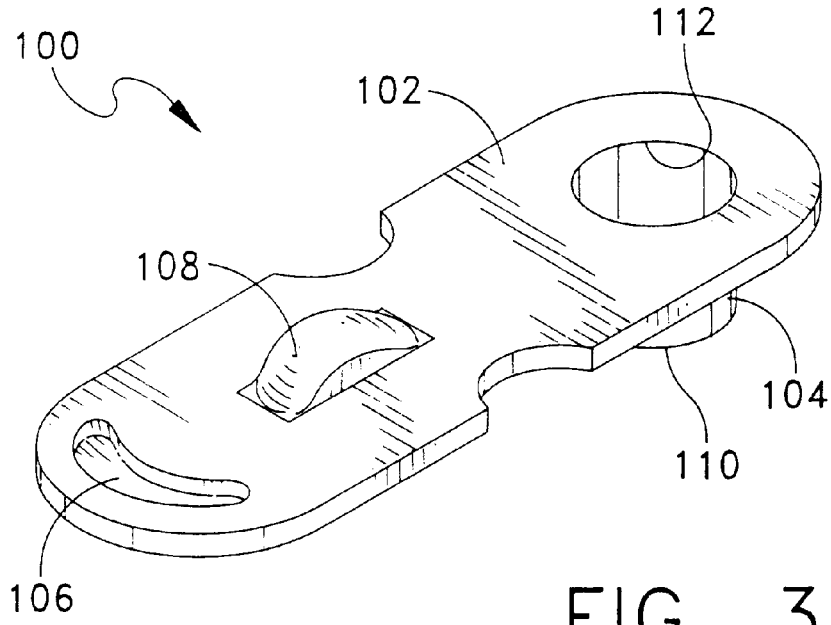
FIG. 3 is a top perspective view of the turn button of the present invention.
Figure 4:
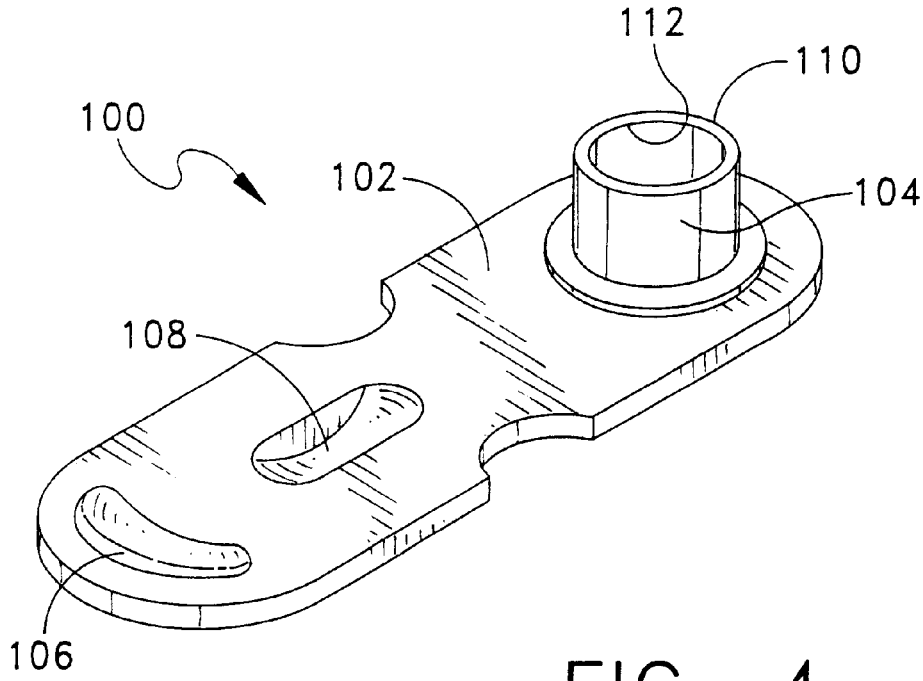
FIG. 4 is a bottom perspective view of the turn button of FIG. 3.
Figure 5:
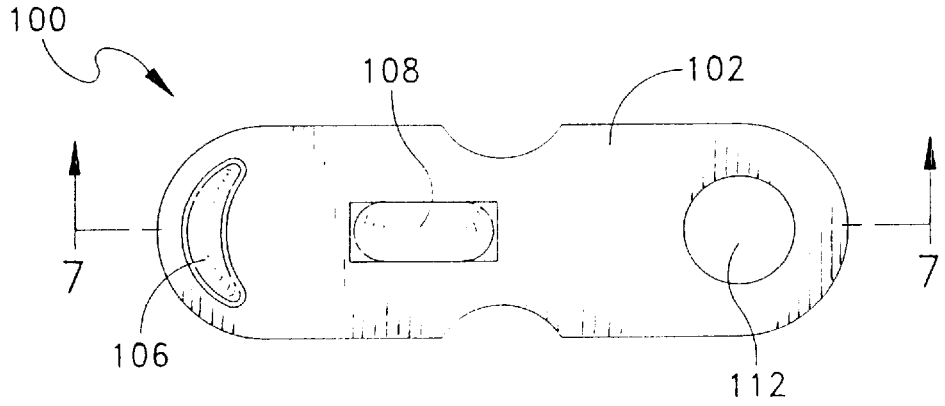
FIG. 5 is a top plan view of the turn button of FIG. 3.
Figure 6:
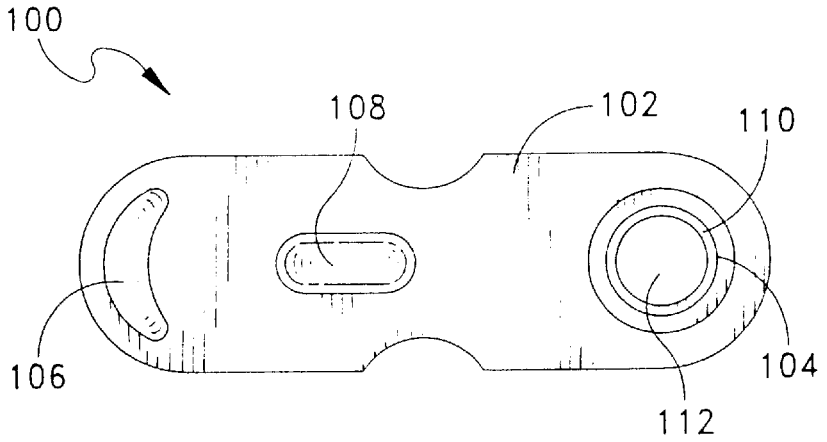
FIG. 6 is a bottom plan view of the turn button of FIG. 3.
Figure 7:
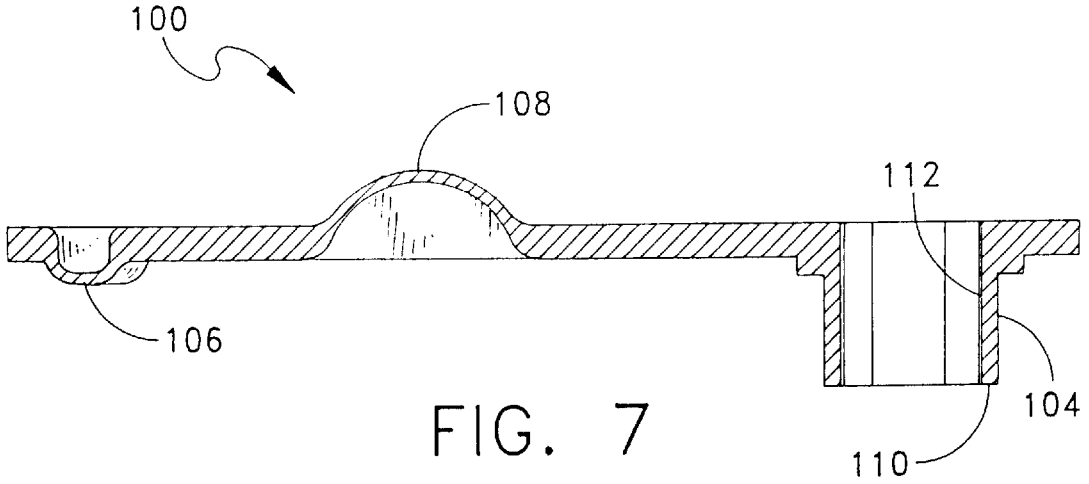
FIG. 7 is a cross-section view through the line 7—7 of FIG. 5.

FIGS. 2A and 2B illustrate another prior art turn button 40 and method of securing the same to a picture frame back 42. In FIG. 2A, a perspective view of another prior art turn button 40 is shown to include an integrated body portion 44 and fastener element 46. The fastener element 46 includes an inwardly tapered or radiused leading edge 48 to facilitate insertion into a pre-punched hole 50. As shown in FIG. 2, a cross-sectional view through the line 2B—2B, the fastener element 46 is forced into the pre-punched hole 50 and into communication with a flaring tool 52 on the opposing side of the picture frame back 42. The flaring tool 52 must have a precise shape 54 and must be aligned carefully below the pre-punched hole 50 to ensure engagement with the tapered fastener element 46. The flaring tool 52 causes the free edge 48 of the fastener element 46 to curl outwardly to secure the turn button 40 to the picture frame back 42. However, this prior art turn button 40 suffers from the disadvantages of requiring the pre-punching of hole 50 to receive the turn button 40 and the requirement of close precision in the flaring tool 52 to ensure proper attachment to the picture frame back 42.

Figure 16:
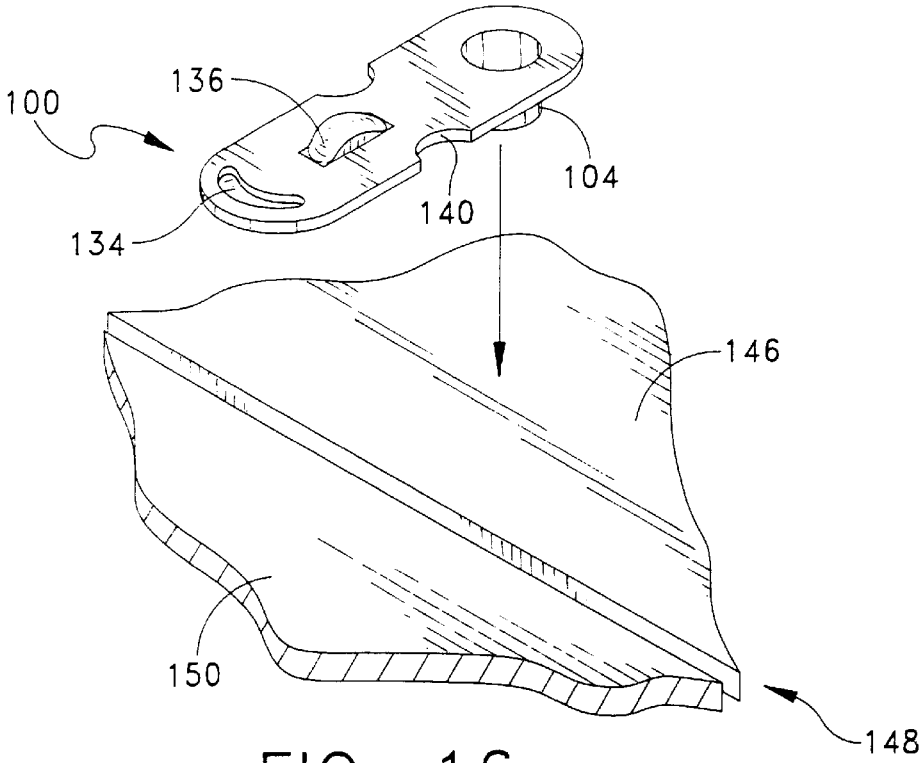
FIG. 16 is a perspective view of the preparing the turn button of the present invention for installation on a picture frame back.
Figure 17:
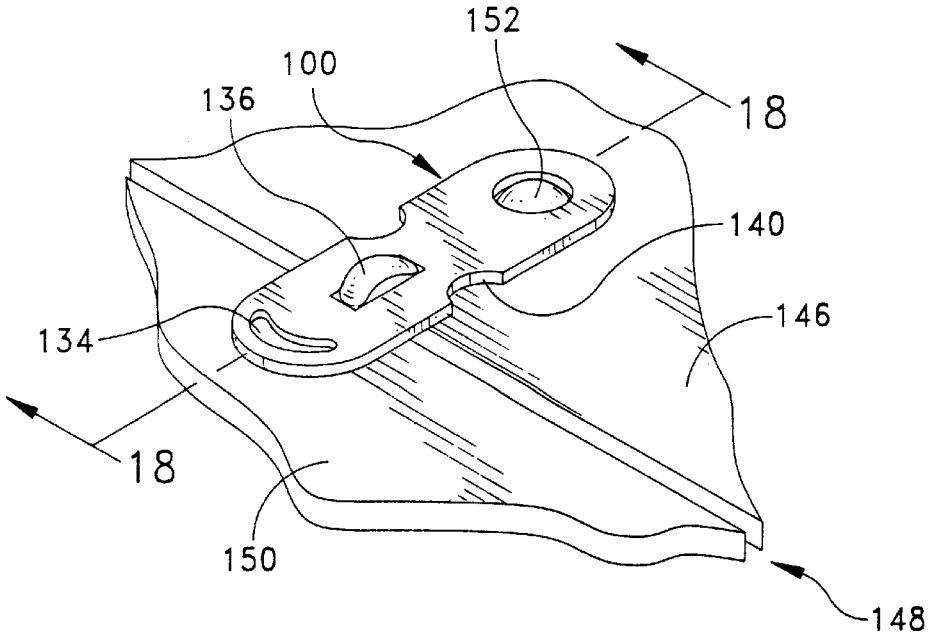
FIG. 17 is a perspective view of the turn button of the present invention installed on a picture frame back.

It should be noted that throughout this specification, it is understood that picture frame backs, such as shown in FIGS. 16 and 17 below, are available in many different styles and configuration, such as one having a hinged center portion and separate center portions which are opened or removed to reveal the picture being displayed. In the Figures herein, a picture frame back 148 is represented as a flat board for ease of illustration but is not intended to limit the scope of the present invention in any way.

Turning now to FIGS. 3–7, the individual turn button 100 of the present invention prior to installation is shown. In FIGS. 3–7, the turn button 100 of the present invention is shown as a separate device, however, as will be described in detail below, it is preferred that a strip of such turn buttons 100 be provided in on a reel for coil feeding into an automatic assembly for actual installation onto a picture frame back 148, as shown in FIG. 17.

Figure 14:
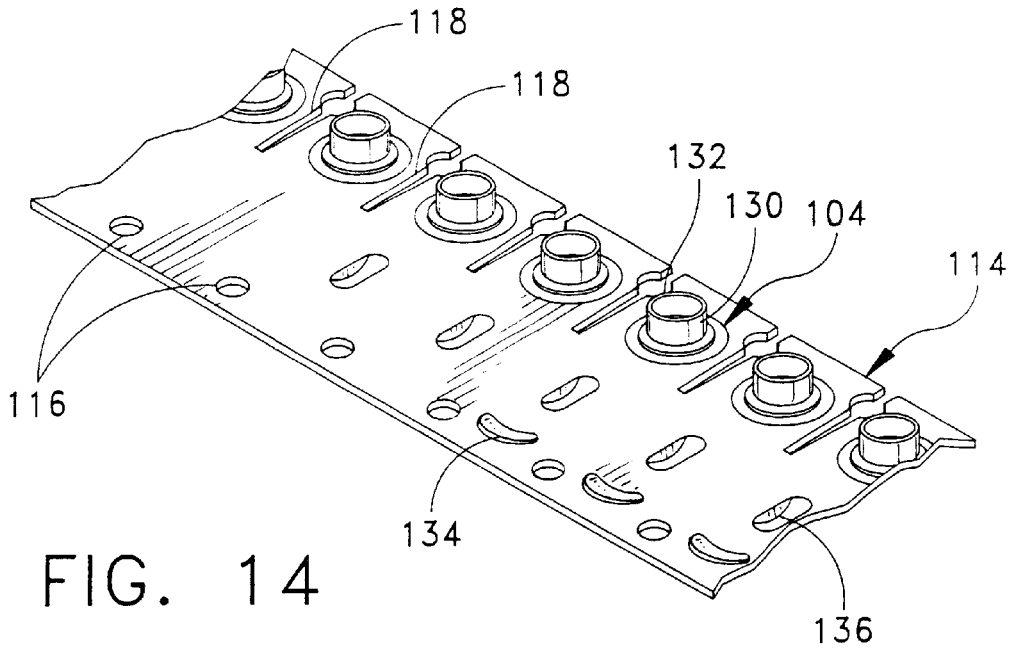
FIG. 14 is a perspective view of the progressive tooling step of forming glide pads and turning buttons.
Figure 15:
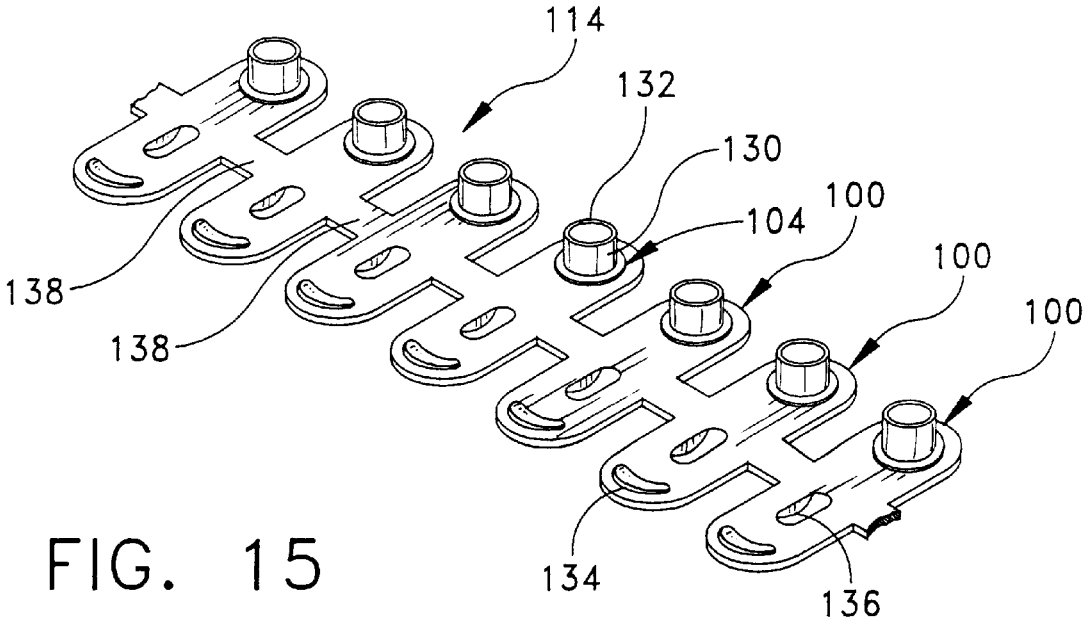
FIG. 15 is a perspective view of the progressive tooling step of trimming excess material to forming the turn buttons leaving connective material between each turn button.

Referring to FIGS. 3–7, the turn button 100 of the present invention includes a substantially planar body portion 102 with a pivot boss 104, a glide pad 106 and a turning knob 108. The pivot boss includes a raised circumferential step and has an aperture therethrough. The pivot boss 104 is connected to the body portion 102. As will be discussed in detail below in connection with FIGS. 8–15, the turn button 100 of the present invention is blanked from a metal sheet and is, preferably, in a coil of turn buttons for automated assembly and installation. The formation of the pivot boss 104 leaves its free end 110 as a straight circular cutting edge capable of cutting or piercing through a picture frame back with an aperture 112. Also, as discussed below in connection with FIGS. 16–19 below, operation of the turn button 100, employing the glide pad 106 and turning knob 108, are shown. When coiled on a reel (not shown), a partially finished strip 114 (as shown in FIG. 15, below) of connected turn buttons 100 use the turning knob 108 for balance to prevent jamming of layers of the coil and to provide spacing about the coil. Further, the turning knob 108 may be employed by the automated equipment to register and index the coil of turn buttons 100 during the installation on a picture frame back.

FIGS. 8–15 illustrate the formation of a strip or coil 114 of turn buttons 100 of the present invention with progressive tooling in a unique method to enable high speed installation onto picture frame back with automated machinery. Details regarding the structure and configuration of the parts and components of the progressive tooling need not be discussed herein as it is well know in the art. However, the particular, method and sequence of the step of forming the unique turn button 100 are discussed below as they are in accordance with the present invention.

Figure 8:
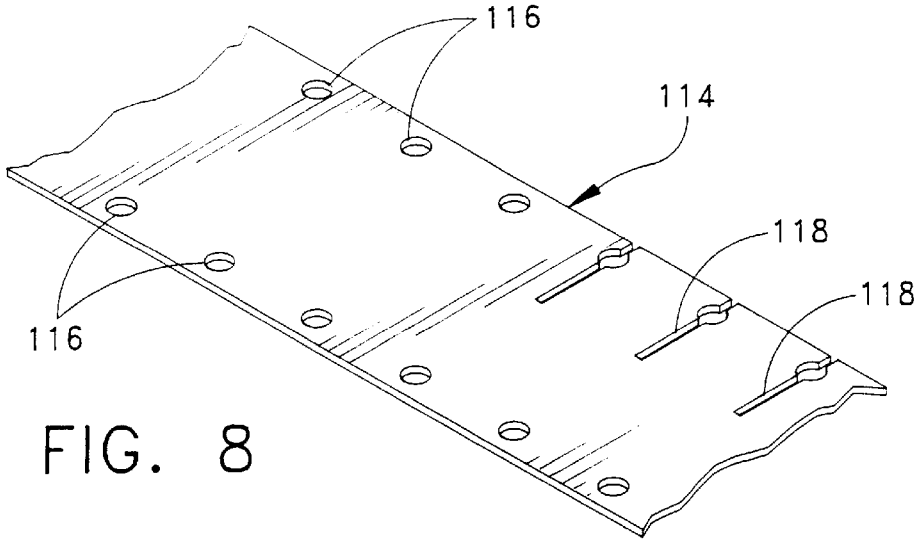
FIG. 8 is a perspective view of an initial step in the progressive tooling of a coil strip of turn buttons in accordance with the present invention.

In FIG. 8, a substantially rigid, yet formable strip 114 of material is provided. It is preferred that the material 114 be metal, such as steel, for optimum performance of the turn button 100. Registration holes 116 are provided to assist in the movement of the strip 114 of material through the progressive tooling. Upper slots 118 are formation to initially define the individual turn buttons 100. For illustration purposes and simplicity, the formation of an individual turn button 100 will be discussed but it should be understood that such formation is being done progressively to a series of turn buttons 100 along the strip 114 of material.

FIGS. 16 and 17 illustrate the general positioning of the turn button 100 of the present invention on a picture frame back 148. The coil strip 114 of turn buttons 100 is loaded onto a reel (not shown) and is fed into the automated assembly machinery that may be optionally placed inline with other hardware application machinery. The assembly machinery trims the connective material 138 from between the turn button 100. A semi-circular cut-out 140, instead of a straight-line cut, is made for aesthetic purposes to avoid excess edges on the side of the turn button 100. A ball nose punch 142 or anvil is provided below the area of the picture frame back 148 that will receive the pivot boss 104 of the turn button 100.

Figure 9:
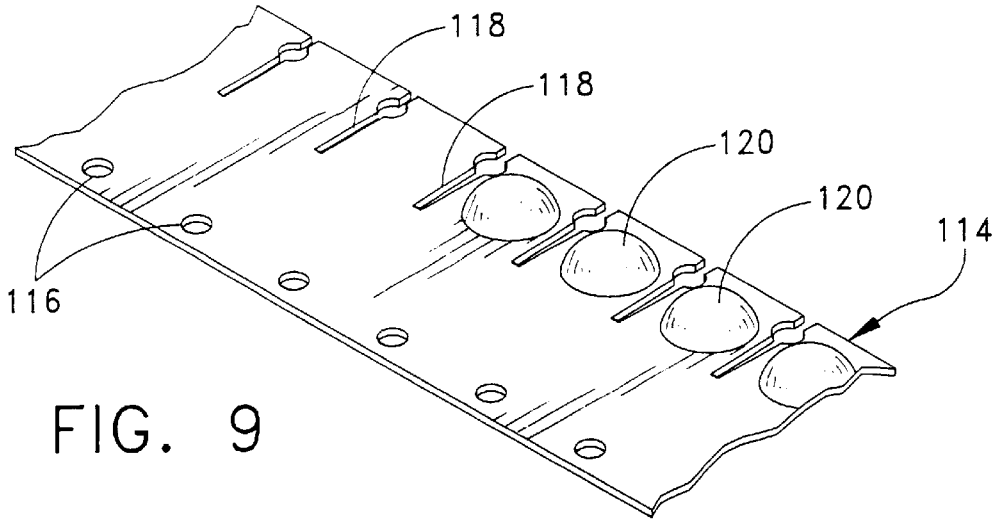
FIG. 9 is a perspective view of the progressive tooling step of drawing pivot boss material.
Figure 10:
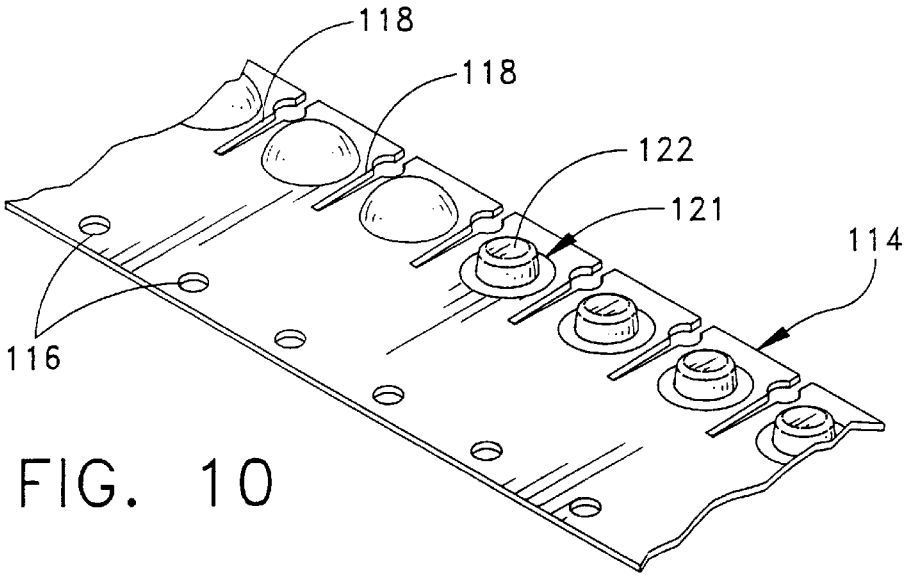
FIG. 10 is a perspective view of the progressive tooling step of forming the pivot boss material.
Figure 11:
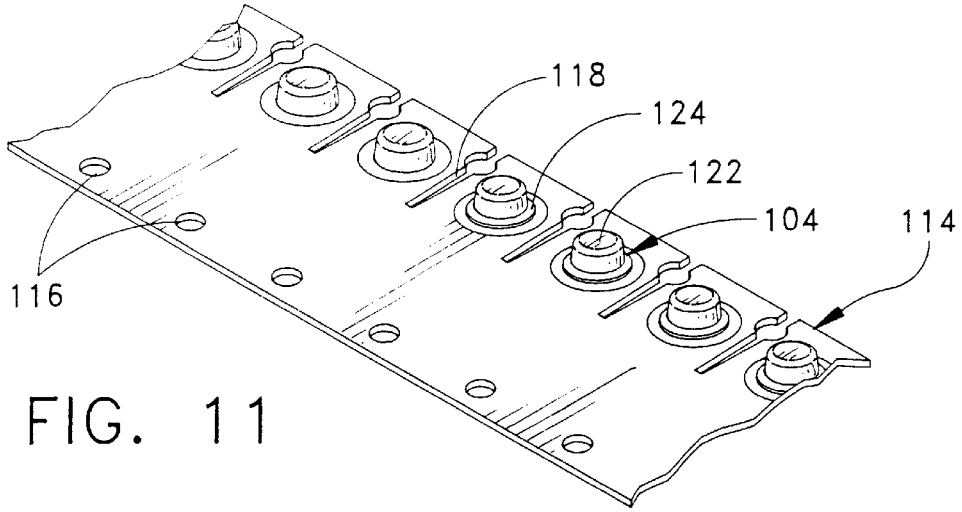
FIG. 11 is a perspective view of the progressive tooling step of creating a step in the pivot bosses.
Figure 12:
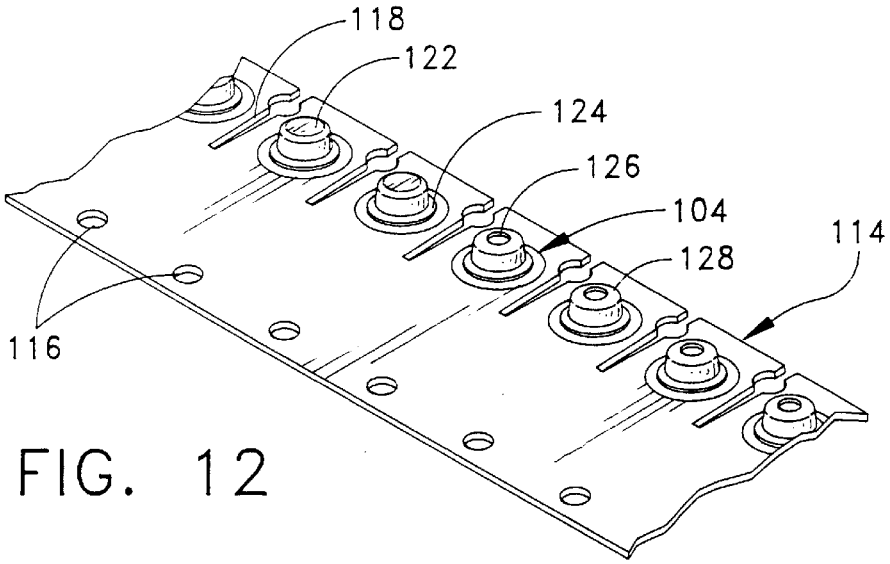
FIG. 12 is a perspective view of the progressive tooling step of forming holes in the pivot bosses.
Figure 13:
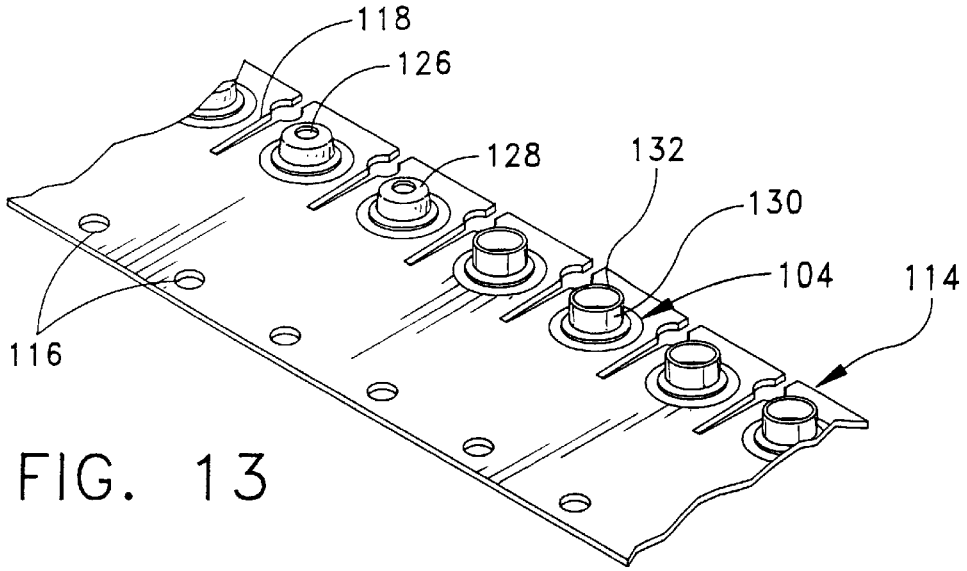
FIG. 13 is a perspective view of the progressive tooling step of extruding the cylindrical walls of the pivot bosses.

As shown in FIG. 9, a volume of material 120 is drawn from the material in the shape of a dome to initiate the formation of a pivot boss, generally referred to as 104. This formation is carried out by the appropriate tooling (not shown). Next, in FIG. 10, the dome of material 120 is further formed into a substantially cylindrically-shaped structure 122 to define the circumferential dimensions of the pivot boss 104. In FIG. 11, a circumferential step 124 is formed into the pivot boss 104. FIG. 12 illustrates the punching of an aperture 126 through the top wall 128 of the pivot boss 104 to remove additional strip material. As illustrated in FIG. 13, the formed material is now extruded to form a cylindrical upstanding wall 130 with an unfinished, sharp upper edge 132. As will be discussed below in connection with the method of installation of the turn button 100 of the present invention in connection with FIGS. 16–19, the sharp upper edge 132 serves as a cutting edge to pierce a picture frame back 148. FIG. 14 illustrates the formation of glide pad 134 in the same direction as the pivot boss 104 as well as the formation of the turning knob 136 formed in the opposite direction thereof. Lastly, FIG. 15 shows further trimming of the material to leave a series of turn buttons 100 connected together in a coil-feedable strip 114 with connective material 138 remaining between each individual turn button 100. The height of the glide pad 134 and circumferential step 124 are preferably of the same height to position the body portion 102 equally away from the surface of a picture frame back 148.

Figure 19:
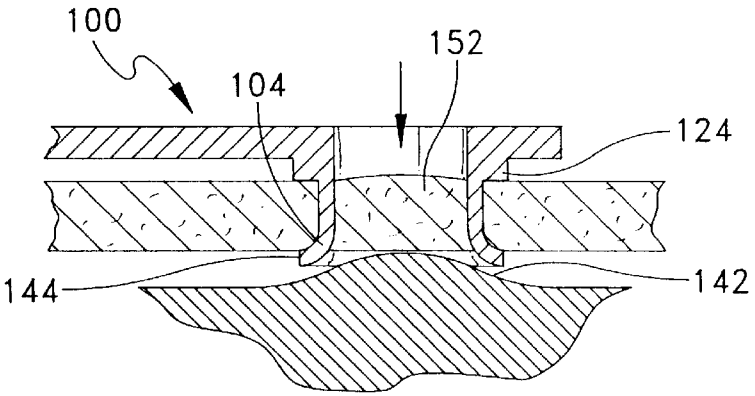
FIG. 19 is a cross-sectional view through the line 18—18 of FIG. 17 with flaring tool in place for illustration purposes.

The coil strip shown in FIG. 15 is suitable for loading into an automated assembly machine (not shown) that is capable of serially receiving a coil strip 114 of turn buttons 100 and attaching them to a desired work piece, such as a picture frame back 148. As shown in FIG. 19, the pivot boss 104 of the turn button 100 is driven through the desired portion of the picture frame back 148 into communication with the ball nose punch 142. Such communication flares out the free edge 110 of the pivot boss 104 to a curled gripping edge 144 to maintain the entire turn button 100 in place and prevent the turn button 100 from being easily being removed. Since the free edge 110 of the pivot boss 104 is wide relative to the edges of the prior art turn buttons, such as in FIGS. 2A and 2B, a less precise punch can be employed requiring an overall less precise installation which makes the setup and installation much easier and less complicated.

Figure 18:
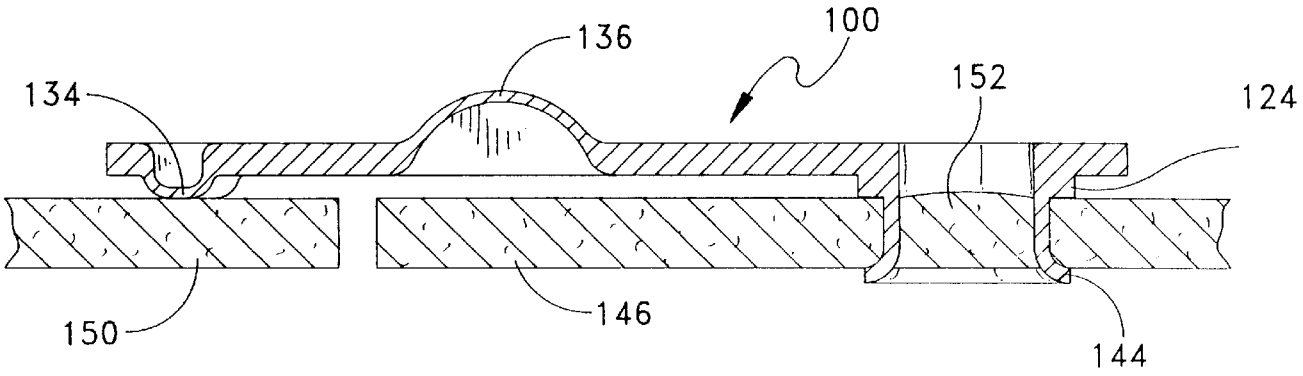
FIG. 18 is a cross-sectional view through the line 18—18 of FIG. 17.

Referring now specifically to FIGS. 17 and 18, the placement and orientation of the turn button 100 of the present invention is shown. It is preferred that the turn button 100 is attached to the peripheral portion 146 of a picture frame back, generally referred to as 148, with pivot boss 104 attached to such peripheral portion 146. This permits the turn button 100 to rotate therearound to allow its free rotating end with glide pad 134 to communicate with a central portion 150 of the picture frame back 148. As best seen in FIG. 18, the unique design of the turn button 100 of the present invention only touches the picture frame back 148 at the step 124 of the pivot boss 104 and the glide pad 1374 itself to avoid unnecessary scratching or marring of the picture frame back 145. The center "core" 152 of the picture frame back 148 inside the pivot boss 104 remains intact providing a pleasing aesthetic appearance similar to a riveted turn button of the prior art. In addition, the firm connection of the turn button 100 to the picture frame back 148 provides a snug connection while being still easy to turn without undesirable free-spinning "helicoptering" of the turn button 100 that is frequently encountered in prior art riveted turn buttons.

While the foregoing method of manufacture and installation of the turn button of the present invention is preferred, it is only one of many different methods that can be employed to carry out the present invention. For example, the turn button 100 configuration of the present invention can be formed into individual members that are manually attached or accommodated by a vibratory feeder for attachment by automated machinery. The present invention may be carried out in an inline assembly with other hardware installation operations or it may be operated standalone in a separate step apart from other hardware installation operations.

The turn button 100 of the present invention can be used whenever it is required to maintain two members in the same plane as one another. The turn button 100 is well suited to serve as a closure for a wide array of applications. Also, the turn button 100 is, preferably, made and formed from steel; however, it is possible to use other materials, such as brass. The material employed may be pre-plated, such as black oxide, or finished as desired to suit the particular application or requirement of the turn button 100. As can be understood, the dimensions and size of the turn button 100 can be modified to suit the application. The length of the pivot boss 104 can be easily modified by drawing and extruding more or less material to suit the desired application.

It would be appreciated by those skilled in the art that various changes and modifications can be made to the illustrated embodiments without departing from the spirit of the present invention. All such modifications and changes are intended to be covered by the appended claims.

What is claimed is:

1. A turn button for installation on a picture frame back, comprising:

an elongated metal body portion having a bottom side surface and a top side surface and a first end and a second end; said bottom side surface being opposite said top side surface and said first end being opposite said second end; and a pivot boss on said bottom side surface adjacent said first end; said pivot boss including a downwardly depending cylindrical wall with a free lower edge and an aperture therethrough for rotatably securing said turn button through a first portion of a picture frame back; said free lower edge of said cylindrical wall being a substantially straight cutting edge capable of piercing through a picture frame back leaving within said cylindrical wall an inner region of said first portion of said picture frame back and leaving outside of said cylindrical wall an outer region of said first portion of said picture frame back; and a circumferential step in said pivot boss positioned between said body Portion and said free lower edge; said circumferential step having a step surface engagable with said first portion of said Picture frame back.

2. The turn button of claim 1, further comprising:

a glide pad having a height and a substantially smooth outwardly facing surface on said bottom surface proximal said second end of said body portion for engaging a second portion of said picture frame in order to retain said second portion in a predetermined position relative to said first portion.

3. The turn button of claim 1, further comprising:

a turning knob on the top side surface of said body portion between said pivot boss and said glide pad for rotating said turn button relative to said first portion of said picture frame back.

4. The turn button of claim 1, wherein the distance between said step surface and said body portion is substantially equal to the height of said second boss.

5. The turn button of claim 1, wherein said turn button is made of metal.

6. The turn button of claim 1, wherein said turn button is integrally struck from a sheet of metal.

* * * * *